US005724842A

United States Patent [19]

Beattie et al.

[11] Patent Number: 5,724,842

[45] Date of Patent: Mar. 10, 1998

[54] ROLLING OF METAL STRIP

[75] Inventors: Robert John Beattie; Philip Francis Round; Andrew Storey, all of Dorset, United Kingdom

[73] Assignee: Davy McKee (Poole) Limited, Dorset, England

[21] Appl. No.: 600,973

[22] Filed: Feb. 20, 1996

[30] Foreign Application Priority Data

Aug. 26, 1993 [GB] United Kingdom ..... 9317928

[51] Int. Cl.[6] ..... B21B 37/00

[52] U.S. Cl. ..... 72/12.2; 72/201

[58] Field of Search ..... 72/8.4, 8.5, 11.3, 72/12.2, 200, 201, 202, 342.2, 364, 365.2

[56] References Cited

U.S. PATENT DOCUMENTS

| | | | |
|---|---|---|---|
| 4,274,273 | 6/1981 | Fapiano et al. | 72/8.5 |
| 4,379,396 | 4/1983 | Hope et al. | 72/8.5 |
| 4,569,023 | 2/1986 | Wakamiya | 72/11.3 |
| 4,596,615 | 6/1986 | Matsuzaki et al. | 72/201 |
| 4,658,614 | 4/1987 | Wakamiya | 72/200 |
| 4,785,646 | 11/1988 | Uekaji et al. | 72/8.5 |
| 4,899,547 | 2/1990 | Irwin | 72/12.2 |
| 5,121,332 | 6/1992 | Balakrishnan et al. | 364/471 |

FOREIGN PATENT DOCUMENTS

| | | | |
|---|---|---|---|
| 5890314 | 5/1983 | Japan | 72/8.5 |
| 6049807 | 3/1985 | Japan | 72/12.2 |
| 0626713 | 1/1987 | Japan | 72/11.3 |
| 0162206 | 3/1989 | Japan | 72/12.2 |
| 0299210 | 4/1990 | Japan | 72/11.6 |
| 2197309 | 8/1990 | Japan | 72/8.6 |

*Primary Examiner*—Lowell A. Larson
*Assistant Examiner*—Ed Tolan
*Attorney, Agent, or Firm*—Lee, Mann, Smith, McWilliam, Sweeney & Ohlson

[57] ABSTRACT

A rolling mill (1) for rolling metal strip has provision for applying discrete levels of liquid coolant to the strip and the temperature (te) of the strip leaving the mill is compared with a target temperature (ts) and the temperature (Te) the incoming workpiece is compared with a target temperature (Ts). The difference signals are employed to control the levels of liquid coolant and the rolling speed so that the exit temperature remains substantially equal to the target exit temperature.

7 Claims, 3 Drawing Sheets

ROLLING OF METAL STRIP

This invention relates to the rolling of metal strip, particularly, but not solely, to the warm rolling of aluminium and its alloys. It is well known that the temperature of strip exiting from a rolling mill is a factor in determining the metallurgical quality of the metal strip. For aluminium and its alloys it is important that the temperature of the strip exiting the rolling mill, or the last stand, of a multistand rolling mill, is at, or close to, a predetermined value so that the metallurgical properties of the metal are enhanced.

It is well known that the temperature of strip exiting from a rolling mill varies with the rolling speed of the mill, the faster the rolling speed, the higher the temperature. Consequently, the exit temperature of the strip can be controlled, to some degree, by adjusting the rolling speed.

It is also known to control the temperature of metal strip being rolled in a multistand rolling mill by applying liquid coolant, usually water, to the strip. The coolant may be applied to the strip when it is on a roller table downstream of the last stand of the mill or it may be applied to the strip at inter-stand locations.

In U.S. Pat. No. 3,267,709 there is described a method and apparatus for controlling the temperature of a workpiece during rolling. The temperature of the workpiece exiting from the last stand is determined and compared with a desired temperature. the difference, if any, is used to adjust the speed of the mill so that the difference between the actual temperature and the desired temperature is reduced substantially to zero. Provision is made for cooling the workpiece downstream of the mill and the cooling effect of the cooling means is varied commensurate with the varying speed of the rolling mill.

GB-A-1258421 also discloses a method and apparatus for controlling the temperature of a workpiece during rolling. A finishing mill for metal strip comprises a multiplicity of rolling mill stands. Means for applying liquid coolant to the strip are located at inter-stand locations. Temperature detectors are located at selected regions including one immediately downstream of the last stand. The cooling means at each location are adjustable. The rate of flow of the cooling liquid is decreased to compensate for loss of heat from the workpiece as it is fed into the mill and the rate of flow of the cooling liquid is increased to maintain the delivery temperature substantially constant as a function of the acceleration rate of the workpiece.

U.S. Pat. No. 3,418,834, discloses a hot strip rolling mill which is controllably accelerated to hold the desired strip delivery temperature at a substantially constant level. Closed loop control of mill acceleration is based on delivery temperature detection. Downstream of the last stand of the multi-stand rolling mill, provision is made for supplying liquid coolant to the strip.

According to the present invention a method of rolling metal strip in a rolling mill having means for determining the temperature of the strip entering the mill, means for determining the temperature of the strip exiting from the mill and provision for applying liquid coolant to the strip comprising the steps of accelerating the mill to an initial rolling speed based on the rolling speed of the previously rolled strip and the difference in entry temperature between the strip being rolled and the previously rolled strip, obtaining a signal representing the difference between the temperature of the strip exiting the mill and a target exit temperature and employing said difference signal to control both the liquid coolant applied to the strip and the variation of the rolling speed from said initial rolling speed in the sense to reduce said difference signal substantially to zero.

In a preferred arrangement, the rolling mill comprises at least those stands arranged in tandem and the liquid coolant is applied to the strip at interstand locations. At each interstand location, the levels of liquid coolant conveniently include maximum coolant flow, minimum coolant flow and at least one intermediate level of coolant flow. Switching from one level to another is controlled by a non-linear deadband type switching device and switching from one level to another level is inhibited in a predetermined time interval following a previous switching.

In order that the present invention may be more readily understood, it will now be described, by way of example only, with reference to the accompanying drawings, in which.

Figure 1:
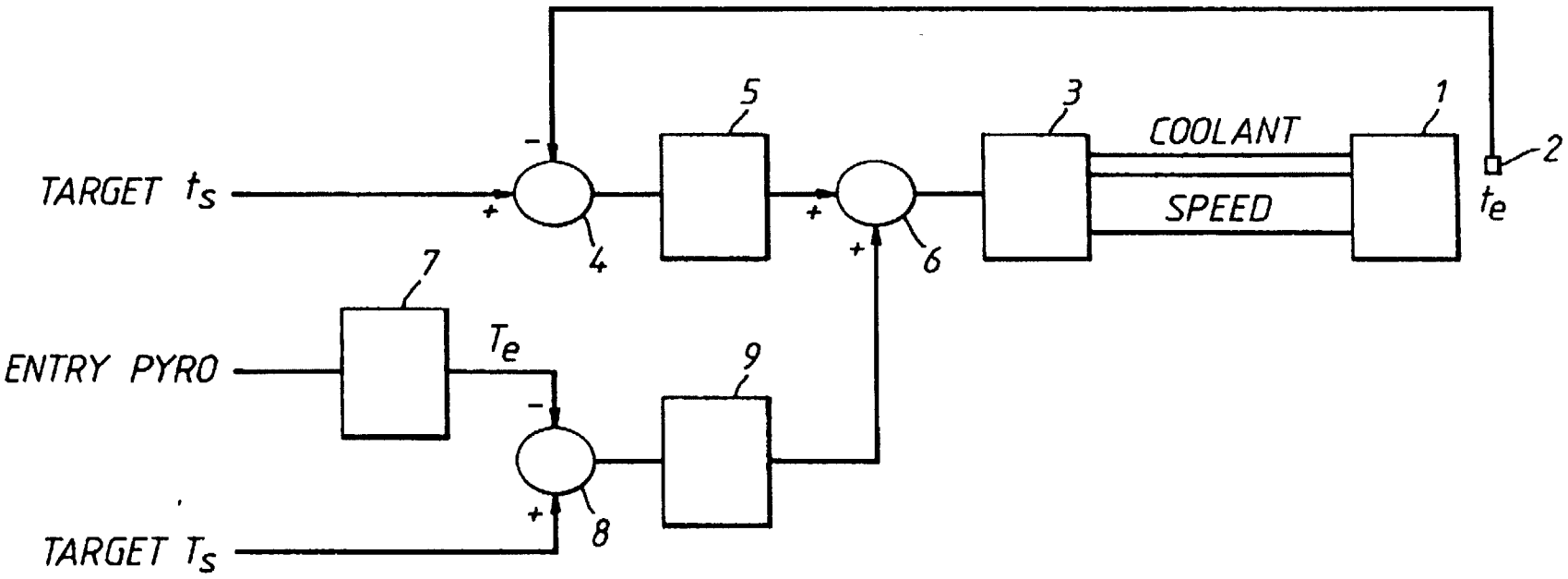
FIG. 1 is a block diagram of a control system in accordance with the invention.

Referring to FIG. 1, a multistand rolling mill for rolling aluminium and its alloys comprises, say, three stands arranged in tandem with liquid cooling provided between the first and second stands and between the second and third stands. The mill is indicated by reference numeral 1. A pyrometer 2 preferably located immediately downstream of the last stand measures the temperature of the strip exiting from the last stand.

The speeds of rotation of the rolls of the three stands, and the control of the coolant applied to the strip between the stands, is controlled by a control scheduler 3.

The output signal $t_e$ from the pyrometer 2 is fed back as a negative signal to a summer 4 to which a positive signal $t_s$ representing the desired exit temperature is also applied and the temperature difference signal, i.e., the error signal, is applied to a feedback controller 5. The output of the controller 5 serves as one positive input to a summer 6, the output of which is connected to the control scheduler 3.

An entry pyrometer, not shown, measures the temperature of the strip entering the mill and the signal Te from this pyrometer is delayed in delay circuit 7, for a time corresponding to the strip transit time from the pyrometer to the first stand, to produce a signal $T_e$ which is compared with the target entry temperature $T_s$ in a comparator 8. The difference signal, i.e., the error signal is supplied to a controller 9 and the output from the controller is fed forward as the second input into the summer 6.

The interstand coolant coverage comprises interstand coolant spraybars (sb) and air and coolant blow-offs (b-o). To minimise the coolant coverage between a pair of stands, the interstand coolant spraybar is switched off and the air/coolant blow-offs are switched on, thereby preventing additional coolant from flowing on to the strip from the mill stands. To maximise coolant coverage, the spraybar is switched on and the blow-offs off, this causes the strip to be flooded with coolant.

The speed control part of the circuit is basically linear, although the mill transport delay does come into account. The coolant coverage part is discrete since there are only three different states:

| state | sb 1–2 | b–o 1–2 | sb 2–3 | b–o 2–3 | effect |
|---|---|---|---|---|---|
| 1 | ON | OFF | ON | OFF | Maximum cooling |
| 2 | ON | OFF | OFF | ON | Intermediate cooling |
| 3 | OFF | ON | OFF | ON | Minimum cooling |

Figure 3:
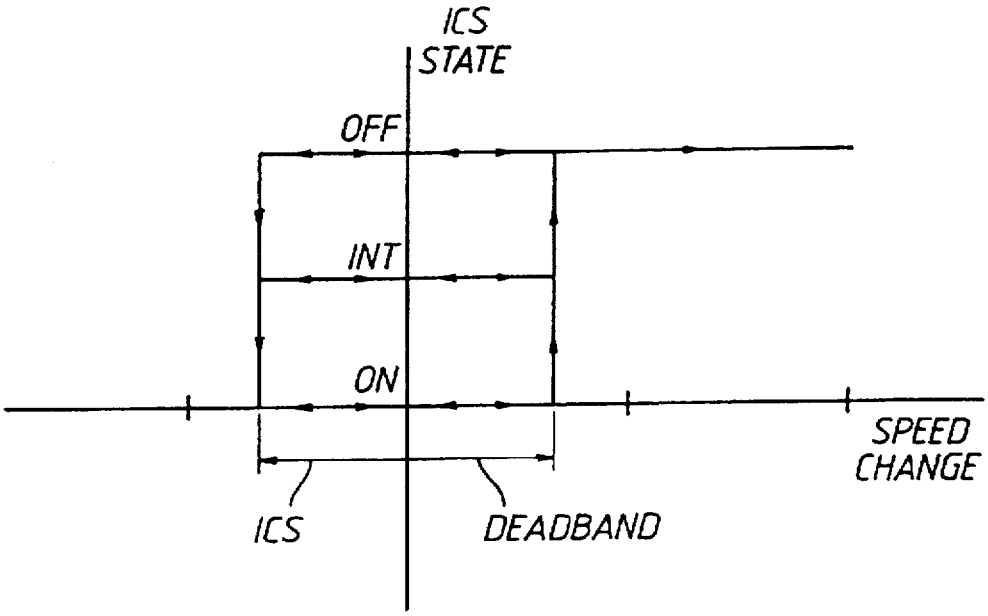
FIG. 3 is a transfer function diagram of a control scheduler (3) forming part of the control system of FIG. 1.

This combination of linear and non-linear is handled by the control scheduler 3 which for cooling control is in the form of a deadband controller as shown in FIG. 3. When the speed change required gets above or below a threshold, the control scheduler triggers a transition to the appropriate higher or lower coolant coverage state. It then inhibits further transitions for a certain period to avoid continuous switching.

Figure 2:
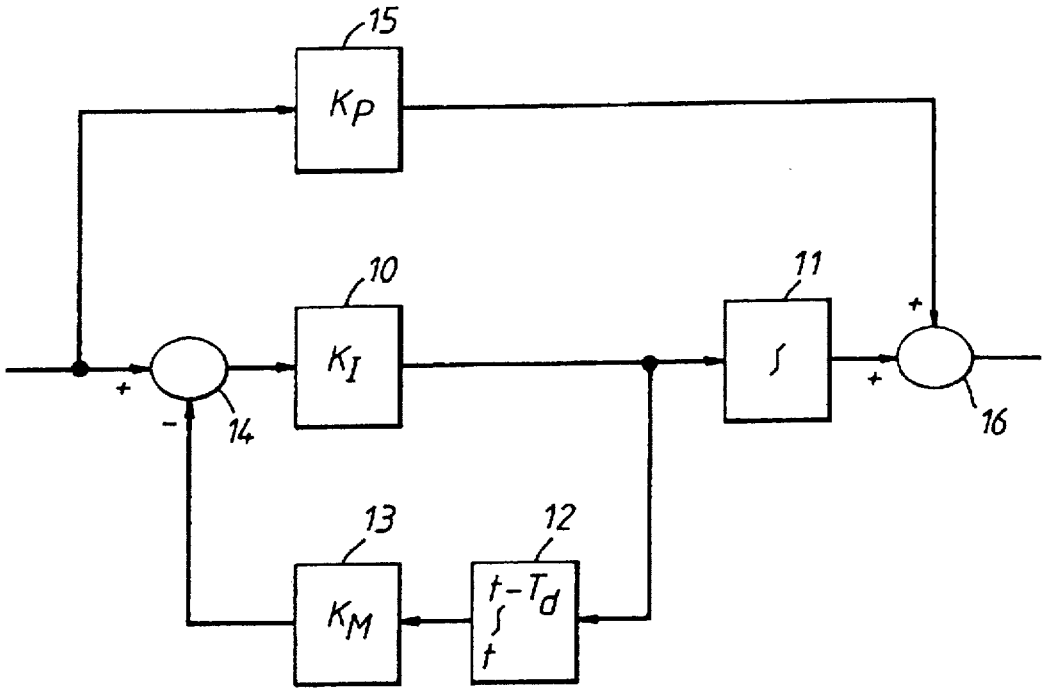
FIG. 2 is a block diagram showing details of the feedback controller (5) shown in FIG. 1.

The feedback controller 5 is a PI type with a Smith Predictor in the integral term as shown in FIG. 2. The aim of the Smith Predictor is to discount the effect of integral corrections already pending due to the transport delay of the mill. The exit temperature error is multiplied at block 10 by the integral gain $K_I$ and inputted to the normal integrator 11 and to a fixed period integrator 12 whose integration period is chosen to be the same as the mill transport delay. The output of the fixed period integrator 12 is scaled by the mill gain $K_M$ in block 13 to predict the likely change in exit strip temperature which will result from integral mill speed corrections already pending. This is subtracted in a summer 14 from the original temperature error to produce a difference which is the temperature error still to be corrected for. The proportional part of the PI controller is fed through its proportional gain $K_P$ in block 15 and summed at 16 with the output of the integral loop to generate the total feedback speed correction.

Components 7, 8 and 9 shown in FIG. 1 provide a feedforward signal. The outputs of the proportional feedforward controller 9 and the feedback controller 5 are summed at 6 to produce a single speed change signal for the control scheduler 3. As far as the speed control part of the system is concerned, the control scheduler has no effect. For coolant control, the control scheduler works as illustrated graphically in FIG. 3. The horizontal axis represents the speed change required. When this goes above or below a threshold value, a coolant system transition is triggered. For example, say the system starts rolling a slab with the coolant system ON, i.e., producing a maximum cooling; if the strip is too cold, then a positive speed change error will be generated, causing the mill to speed up and raising the exit strip temperature. If the speed change required goes above a threshold value, then the control scheduler will trigger a transition in the coolant system to its INT (intermediate) state, causing one of the sprays to be switched off (and the associated blow-offs to be switched on). It also triggers a timer which temporarily inhibits further transitions. As a result of the decreased coolant, the exit strip temperature will increase and the required speed change may decrease slightly. Since the control scheduler incorporates some hysteresis, this will not generate a transition back on the ON state. If the strip continues to cool, the required speed change will again increase. When it goes back above the threshold, a second transition will be triggered to the OFF state, in which both sprays will be off and strip cooling will be at a minimum. This may again cause the speed change required to reduce slightly, but not enough to generate a negative going transition. The width of the control scheduler deadband is chosen such that the change in the speed change signal resulting from a state transition is not large enough to cause a negative going transition. To prevent multiple transitions in the same direction, i.e., ON to INT to OFF, being triggered, as soon as the speed change goes above the threshold, a timer is fired as soon as a single transition is made preventing further transitions until the effect of the first transition has had time to propagate through the mill. The duration of the inhibit timer is calculated from physical separation of the mill stands and the known strip speed from each stand.

Also to improve head end response, a recommended target speed is calculated based on the speed when the previous coil got on target temperature and the entry temperature difference between the current coil and the previous one, i.e.

$$S_N = S_C - k\left\{\frac{(T_N - T_C)\times\frac{\partial t}{\partial T}}{\frac{\partial t}{\partial T}}\right\}$$

where $S_N$—recommended run speed target $S_C$—speed at which the exit temperature was on target in the previous coil k—multiplying factor (default 1.0)

$T_N$—entry temperature of the next coil $T_C$—entry temperature of the previous coil $$\frac{\partial t}{\partial T}$$

—rate of change of exit temperature with entry temperature $$\frac{\partial t}{\partial S}$$

—rate of change of exit temperature with mill speed. where $$\frac{\partial t}{\partial T} \text{ and } \frac{\partial t}{\partial S}$$

are previously found either from special tests or by on-line identification during normal mill operation.

If there has been no rolling for a period of time, for example, if the mill has been shutdown for maintenance, then values of $S_c$ and $T_c$ may be retrieved from stored data.

The feedforward loop has two different modes of operation. In "offset" mode, it uses the difference between the measured entry temperature and a target entry temperature. In "lock-on" mode, operation of the feedforward loop is delayed until the exit temperature is on target, it then stores the entry temperature of the strip and uses any subsequent difference as the feedforward error signal. This improves performance near the strip tail.

Figure 4:
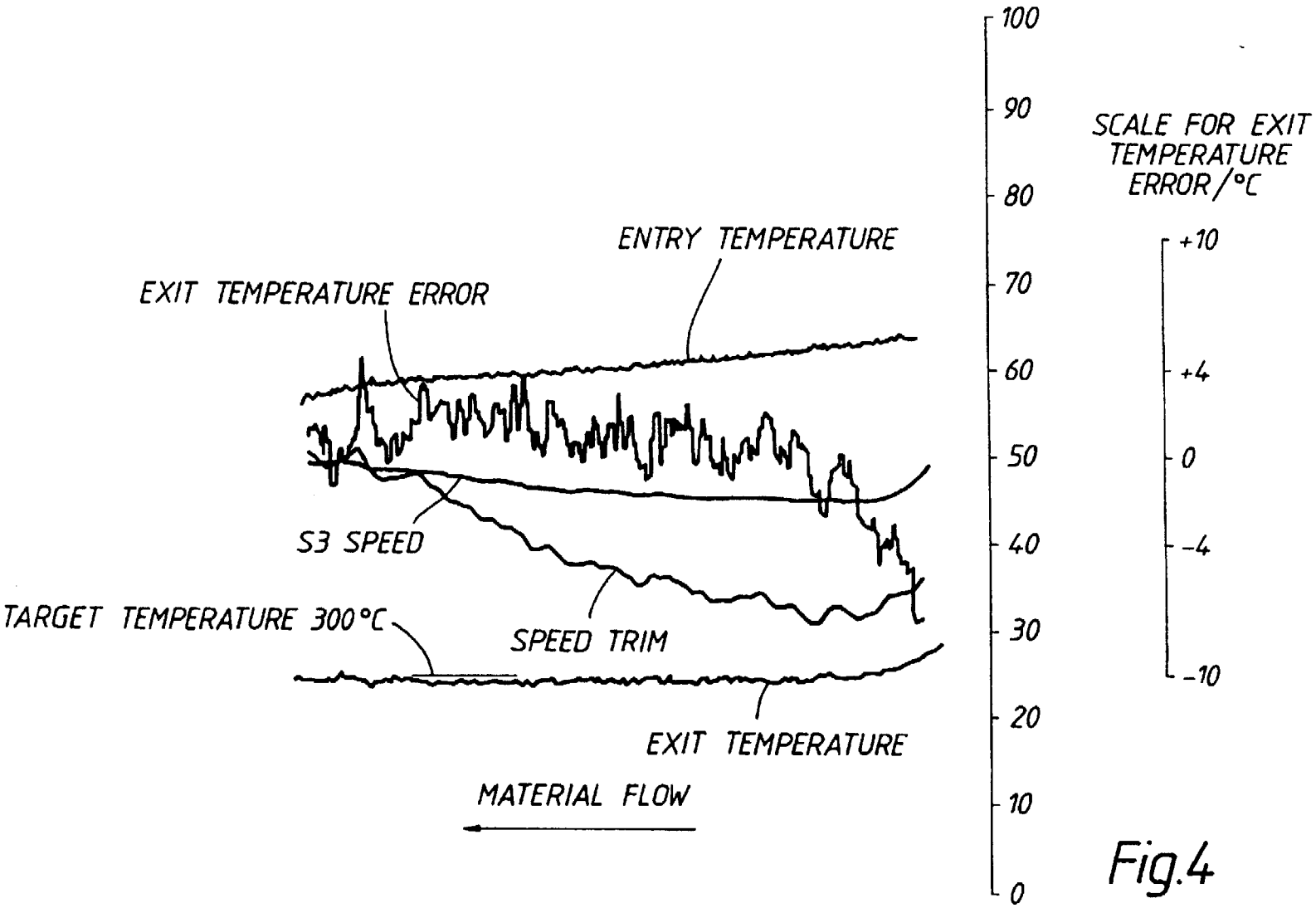
FIG. 4 shows graphs of certain parameters of the control system.

It can be seen from FIG. 4 that, at the beginning of rolling, the pyrometer 2 indicates that the exit temperature of the strip is above the target temperature of 300° C. The exit error signal, which is the output of the adder 4, is shown to be at its maximum level, and this error signal is applied to the controller 5. The controller 5 produces a speed trim signal and the corresponding rolling speed of the last stand 53 is shown. It can be seen from the exit temperature graph that the temperature falls until the target temperature is reached wherefrom the speed trim is kept at a suitable value to eliminate any errors and the exit temperature remains substantially constant at the target temperature.

We claim:

1. A method of rolling metal strip in a rolling mill which has means for determining the temperature of the strip entering the mill, means for determining the temperature of the strip exiting from the mill and means for applying liquid coolant to the strip, said method comprising the steps of accelerating the mill to an initial rolling speed based on the rolling speed of strip previously rolled in the mill and the difference in entry temperature between the strip being rolled and the previously rolled strip;

obtaining a signal representing the difference between the temperature of the strip exiting the mill and a target exit temperature and employing said difference signal to control both the quantity of liquid coolant applied to the strip and the variation of the rolling speed from said initial rolling speed in the sense to reduce said difference signal substantially to zero.

2. A method as claimed in claim 1 in which the rolling mill comprises at least three stands arranged in tandem and the liquid coolant is applied to the strip at interstand locations.

3. A method as claimed in claim 2 in which at each interstand location the means for applying liquid coolant can operate at maximum coolant flow level, minimum coolant flow level, and at least one intermediate level of coolant flow and switching means are provided for switching from one level to another level, the operation of said switching means being inhibited for a predetermined time interval following a previous switching operation.

4. A method as claimed in claim 3 in which the levels of liquid coolant flow are controlled by a non-linear deadband-type switching mechanism.

5. A method as claimed in claim 1, in which the exit difference signal is supplied to a feedback controller of the PI type.

6. A method as claimed in claim 5 in which the feedback controller includes a Smith Predictor which serves to discount the effect of integral corrections already pending due to the transport delay of the mill.

7. A method as claimed in claim 6 in which a signal is obtained in said controller which predicts the likely change in exit strip temperature which will result from mill speed corrections already pending and said signal is subtracted from the exit difference signal.

* * * * *